United States Patent [19]

Acker

[11] 3,952,981

[45] Apr. 27, 1976

[54] FLAG HOLDER

[76] Inventor: Arnold E. Acker, No. 6B 20800 Homestead Road, Cupertino, Calif. 95014

[22] Filed: Sept. 17, 1975

[21] Appl. No.: 614,328

[52] U.S. Cl. ..... 248/291; 248/539

[51] Int. Cl.[2] ..... H01Q 3/02; H01Q 1/08; B60R 19/00; H01Q 1/32

[58] Field of Search ..... 248/38, 40, 41, 42, 248/43, 291, 293, 284

[56] References Cited

UNITED STATES PATENTS

| | | | |
|---|---|---|---|
| 877,802 | 1/1908 | Shuster | 248/40 X |
| 927,369 | 7/1909 | May | 248/293 X |
| 3,521,285 | 7/1970 | Mautner | 248/38 X |

*Primary Examiner*—J. Franklin Foss
*Attorney, Agent, or Firm*—Lowhurst & Aine

[57] ABSTRACT

A flag holder for boats and the like water craft includes a bracket having a retaining portion and an offset portion, with the retaining portion being adapted for being mounted on a support of such a craft, such as the windshield frame, and with the offset portion being spaced from that support. A bar having the flag secured to one end thereof is pivotally mounted on one end of the offset portion. A lever having a latching indent is pivotally mounted on the other end of the offset portion. A pin secured to the bar is adapted to be received in the latching indent to hold the bar and flag in a vertical position. The holder can be attached to either side of the craft.

1 Claim, 2 Drawing Figures

FLAG HOLDER

BACKGROUND OF THE INVENTION

1. Field of the Invention

This invention relates generally to flag holders, and more particularly to a holder for a boat flag which can be mounted on either side of the boat and can be quickly and easily raised and lowered.

2. Prior Art

Flags are employed on boats and other water craft primarily for signalling. It has become the common practice to display a red flag whenever a water skier has fallen and is in the water. With the increased popularity of water sports, boating accidents have increased considerably. Serious injuries and fatalities can occur when a water skier has fallen from his skies and is awaiting to be picked up by his towing boat. Operators of other boats in the area may not be aware of the fallen skier for various reasons and may unintentionally strike or run over such a fallen skier. In an effort to avoid such accidents, it has become the common practice to display a red flag whenever a skier has fallen from his skies and is in the water awaiting to be picked up.

These signalling flags have been hand held in the past, usually by the operator of the towing boat or an observer riding in the towing boat. In the State of California, for example, it is a requirement that, in addition to the operator of the boat, an observer be present in the towing boat to maintain constant surveillance of the skier's activities. Generally, the signalling flag is placed within easy reach of the boat operator or observer, such that it can be quickly and easily reached when it is needed. However, such objects which are unattached have a tendency to move about while the boat is being maneuvered and may move to a position which is outside the reach of either the observer or the operator. As a result, some delay may occur between the time a skier falls from his skies and the observer or boat operator can retrieve the signalling flag and raise it. During that delay, an accident can easily occur.

Furthermore, if it is permissible for the operator of the boat to perform this duty solely, he must be capable of controlling the boats operation while simultaneously holding the signalling flag, such that the fallen skier can be safely retrieved. Since one of the operators hands must be employed for holding the signalling flag, only one hand can be employed for controlling the operation of the water craft. Because of this, accidents are also likely to occur, particularly when the boat is nearing the fallen skier and it is necessary to control both the direction of the craft and its speed. Even the presence of an observer, however, does not eliminate some of these problems. As mentioned above, the signalling flag may have moved from its intended position in the craft. As a result, the signalling flag may not be easily accessible and may often times be out of sight, such as under a seat or cushion. Under such conditions, it is not unusual for the observer to raise the question, "Who has the flag?" It can be appreciated that such a state of affairs is not desirable. It is also possible that the signalling flag has been forgotten and is not in the craft when it is needed.

Accordingly, it can be appreciated that a need exists for a flag holder for a water skiing tow boat which can be quickly and easily raised and lowered and is conveniently within the reach of the operator of the craft.

SUMMARY OF THE INVENTION

It is, therefore, an object of the present invention to provide a flag holder for boats and the like craft which can be quickly and easily raised and lowered.

Another object of the present invention is to provide a flag holder for boats and the like craft which is conveniently within the reach of an observer or the operator of the craft.

A further object of the present invention is to provide a flag holder for boats and the like craft which can be mounted on either side of the craft to accommodate both left and right hand position controls.

These and other objects of the present invention are attained by a flag holder which generally includes a mounting bracket having an offset portion, a flag holding bar pivotally mounted to the offset portion and having a pin secured thereto, and a lever having a latching indent also pivotally mounted on the offset portion, such that the pin can be received in the latching indent when the bar and flag are in a vertical position.

The invention, however, as well as other objects, features and advantages thereof will be more fully realized and understood from the following detailed description, when taken in conjunction with the accompanying drawing, wherein:

BRIEF DESCRIPTION OF THE DRAWING

Like reference numerals throughout the various views of the drawing are intended to designate the same elements.

DETAILED DESCRIPTION OF THE PREFERRED EMBODIMENT

Figure 1:
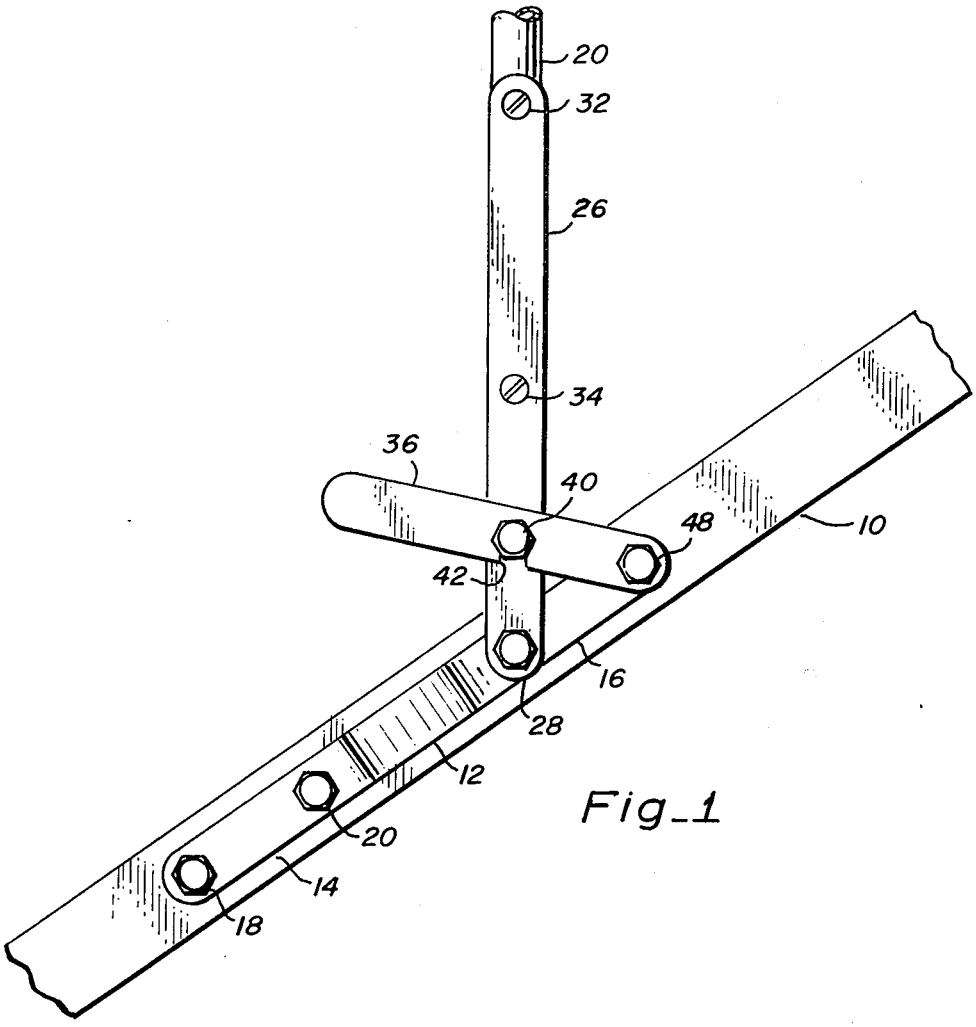
FIG. 1 is a plan view, partially broken away, of a flag holder constructed in accordance with the principles of the present invention.
Figure 2:
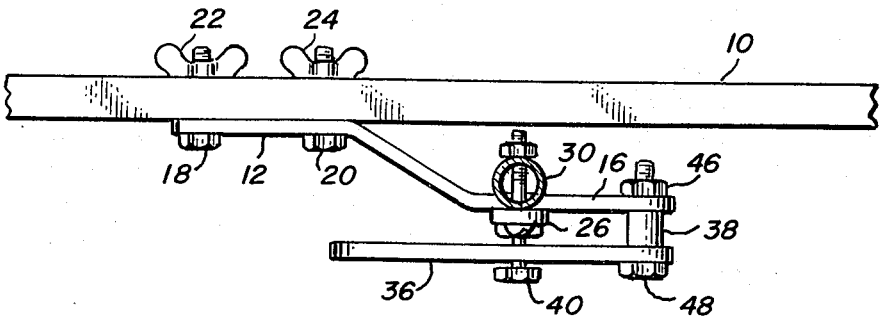
FIG. 2 is a top view of the flag holder illustrated in FIG. 1.

With reference to the drawing in detail, there is shown a flag holder for a boat and the like water craft which is disposed for being mounted on a support 10, such as the frame of a boat windshield or the like. The flag holder includes a retaining bracket 12 which is formed of a retaining portion 14 and an offset portion 16. The retaining portion 14 is secured to the support 10 by a pair of bolts 18 and 20 and wing nuts 22 and 24, respectively. The offset portion 16 is spaced from the support 10.

A bar 26 is pivotally mounted at one end 28 thereof to one end of the offset portion 16 and supports a flag pole 30 by means of bolts 32 and 34 at the other end thereof. A lever 36 is pivotally mounted to the other end of the offset portion 16 and is spaced therefrom by means of a spacer 38. A pin 40 in the form of a bolt is secured to the bar 26 and is disposed for being received in a slot 42 in the lever 36 when the flag holder elements are in the respective positions shown in the drawing.

By lifting the lever 36, the bar 26 and flag pole 30 can pivot in a counterclockwise direction as viewed in FIG. 1, such that the flag (not shown) mounted on the pole 30 can be lowered. It will be noted that regardless of the rotational position of the bar 26, the edge 44 of the lever 36 will remain in engagement with the pin 40. Accordingly, when the bar 26 is raised from the lowered position thereof, the edge 44 of the lever 36 will ride on the pin 40 until the flag pole 30 is raised to a vertical position. When that vertical position is attained, the lever 36 will drop by virtue of the pin 40 being received within the slot 42. Accordingly, the slot 42 forms a latching indentation for holding the bar 26 is a vertical position.

It will be noted that the flag pole 30 can be raised by simply lifting the bar 26 and rotating it to the position shown in the drawing. Also, the bar 26 can be lowered by lifting the lever 36 and removing the pin 40 from the slot 42 to permit the bar 26 to rotate in a counterclockwise direction. Once the flag has been raised, the operator of the water craft can concentrate his efforts on steering and controlling the craft without further worry of providing a proper signal to other water craft in the area.

By removing the wing nuts 22 and 24, the flag holder of the present invention can be easily removed from the support 10. If desired, the flag holder of the present invention can be placed on the opposite side of the support 10, such as may be desirable if the flag holder is to be on the port, rather than the starboard side of the water craft. If the flag holder is placed on the opposite side of the support 10, the level 36 is removed by removing nut 46 and bolt 48. Before replacing lever 36, it is inverted, such that the slot 42 will remain in a downwardly facing position.

The invention claimed is:

1. A flag holder for boats and the like craft, comprising a. a retaining bracket having a retaining portion and an offset portion, said retaining portion being adapted to be mounted on a support of the craft on either side thereof with the offset portion spaced from that support, b. a bar having one end thereof pivotally mounted adjacent one end of said offset portion and disposed for receiving a flag on the other end thereof, c. a pin secured to said bar between the ends thereof, d. a lever having a latching indentation and being pivotally mounted adjacent the other end of said offset portion, said pin being receivable in said indentation to hold said bar in a vertical position, and the length of said lever being greater than the distance from the attachment of said bar and said offset portion to said pin plus the distance from said attachment to the attachment of said lever with said offset portion, such that one edge of said lever rides on said pin as said bar is being raised to and lowered from a vertical position.

* * * * *